US005846343A

United States Patent [19]

Yasuhara et al.

[11] Patent Number: 5,846,343

[45] Date of Patent: Dec. 8, 1998

[54] COLD ROLLED STEEL SHEET EXHIBITING EXCELLENT PRESS WORKABILITY AND METHOD OF MANUFACTURING THE SAME

[75] Inventors: Eiko Yasuhara; Kei Sakata; Toshiyuki Kato, all of Chiba, Japan

[73] Assignee: Kawasaki Steel Corporation, Japan

[21] Appl. No.: 616,078

[22] Filed: Mar. 14, 1996

[30] Foreign Application Priority Data

Mar. 16, 1995 [JP] Japan ..... 7-057532

[51] Int. Cl.[6] ..... C22C 38/14; C22C 38/12; C21D 8/04

[52] U.S. Cl. ..... 148/320; 148/603; 148/651

[58] Field of Search ..... 148/603, 651, 148/661, 320

[56] References Cited

U.S. PATENT DOCUMENTS

| | | | |
|---|---|---|---|
| 5,360,493 | 11/1994 | Matsuoka et al. | 148/320 |
| 5,542,994 | 8/1996 | Jeto et al. | 148/603 |

FOREIGN PATENT DOCUMENTS

| | | | |
|---|---|---|---|
| 63-121623 | 5/1988 | Japan | 148/651 |
| 405202423 | 8/1993 | Japan | 148/603 |
| 406081038 | 3/1994 | Japan | 148/651 |

*Primary Examiner*—Deborah Yee
*Attorney, Agent, or Firm*—Austin R. Miller

[57] ABSTRACT

A cold rolled steel sheet including about 0.001 weight percent or less of carbon (C), about 0.1 weight percent or less of silicon (Si), about 0.3 weight percent or less of manganese (Mn), about 0.05 weight percent or less of phosphorus (P), about 0.003 weight percent or less of sulfur (S), about 0.1 weight percent or less of aluminum (Al), about 0.002 weight percent or less of nitrogen (N), about 0.005 to 0.02 weight percent of titanium (Ti), about 0.001 to 0.01 weight percent of niobium (Nb), and the balance iron and incidental impurities. The total weight percent of carbon, sulfur, and nitrogen is about 0.004 weight percent or less. The content of titanium, carbon, sulfur and nitrogen satisfies the equation: about 4×(C wt %)≦(Ti wt %)−48/14(N wt %)−48/32(S wt %)≦about 12×(C wt %). The method of the invention includes uniformly heating a steel slab having a composition as described above at a temperature T(K) satisfying the following equation:

T(K)×(C wt %+S wt %)≦about 4.0, and within a temperature range from abut 900° to 1,300° C., hot rolling at a finishing temperature of higher than the $A_{C3}$ transformation temperature, coiling at a temperature of about 650° C. or less, cold rolling after pickling at a rolling reduction rate of about 65 to 90 percent, and recrystallization-annealing at a temperature ranging from about 700° to 950° C.

4 Claims, 2 Drawing Sheets

COLD ROLLED STEEL SHEET EXHIBITING EXCELLENT PRESS WORKABILITY AND METHOD OF MANUFACTURING THE SAME

BACKGROUND OF THE INVENTION

1. Field of the Invention

The present invention relates to a cold rolled steel sheet that exhibits excellent deep drawability which is well suited for use in vehicles, plating and like applications.

2. Description of the Related Art

Recently, many regulations governing exhaust gas from automobiles have been issued to address environmental concerns. Demand for lightweight automobiles has simultaneously increased due to the improved fuel efficiency achieved by lightweight automobiles. Higher fuel efficiency reduces the amount of exhaust gas produced.

Decreasing the thickness of the steel sheet used for the body of the automobile effectively decreases the weight of the automobile. High tensile strength steel sheets having a tensile strength of 400 to 550 MPa and excellent press workability are well suited for such applications. High tensile strength steel sheets, however, have some practical problems, including lowered press workability and deteriorated platability caused by the added reinforcing elements. Further, lower ductility results from the decreased sheet thickness.

An alternative method for decreasing weight involves the integration of several body sections composed of many parts. Most conventional cold rolled steel sheets, however, do not satisfactorily respond to such demands because of their poor press workability.

Attempts have been made to improve the press workability of cold-rolled steel sheets for deep drawing. For example, Japanese Laid-Open Patent No. 4-116,124 discloses a method in which carbon, nitrogen, sulfur and phosphorus are decreased as much as possible, with silicon and phosphorus contents being controlled to $0.5\times Si+P<0.012$ percent, so that a cold-rolled steel sheet exhibiting an elongation of 54% and r-value of 2.4 can be produced. However, examples in the disclosure show a maximum r-value of only 2.7. Since cold-rolled sheets are generally used after hot galvanizing or some other plating which causes r-values to decrease by 0.2 to 0.3, the r-value of the cold-rolled sheet must be higher.

Japanese Laid-Open Patent 6-172,868 discloses a method for producing a steel sheet having a higher r-value. However, this method requires control of the dew point and atmosphere during recrystallization annealing, and the box annealing required reduces the effectiveness of the method.

SUMMARY OF THE INVENTION

It is an object of the present invention to provide a cold rolled steel sheet exhibiting high elongation, a high r-value and excellent deep drawability.

It is another object of the present invention to provide a method for producing a cold rolled steel sheet exhibiting such characteristics.

We have discovered that a cold rolled steel sheet exhibiting excellent deep drawability as compared with conventional steel sheets can be produced by controlling the components of the steel as follows:

about 0.001 weight percent or less of carbon (C), about 0.1 weight percent or less of silicon (Si), about 0.3 weight percent or less of manganese (Mn), about 0.05 weight percent or less of phosphorus (P), about 0.003 weight percent or less of sulfur (S), about 0.1 weight percent or less of aluminum (Al), about 0.002 weight percent or less of nitrogen (N), about 0.005 to 0.02 weight percent of titanium (Ti), about 0.001 to 0.01 weight percent of niobium (Nb), and the balance iron and incidental impurities;

wherein the total weight percent of carbon, sulfur, and nitrogen is about 0.004 weight percent or less, and titanium, carbon, sulfur, and nitrogen satisfy the following equation:

about 4×(carbon weight percent)≦(titanium weight percent)−48/14(nitrogen weight percent)−48/32(sulfur weight percent)≦about 12×(carbon weight percent).

A cold rolled steel sheet in accordance with the present invention may further contain about 0.0001 to 0.0010 weight percent of boron as an alloy element, in addition to the above-described components.

The steel sheet in accordance with the present invention is produced by uniformly heating a steel slab having a composition as set forth above at a temperature T (K) satisfying the following equation:

T (K)×(carbon weight percent+sulfur weight percent) ≦about 4.0 within a temperature range from about 900° to 1,300° C., hot rolling at a finishing temperature of higher than the $A_{C3}$ transformation temperature, coiling at a temperature of about 650° C. or less, cold-rolling after pickling at a rolling reduction rate of about 65 to 90 percent, and recrystallization-annealing at a temperature ranging from about 700° to 950° C.

DETAILED DESCRIPTION OF THE PREFERRED EMBODIMENTS

Elements of the steel sheet of the invention will now be explained based on the results of experiments as related by the figures.

Steel sheets were produced by uniformly heating steel slabs containing 0.01 weight percent of silicon, 0.1 weight percent of manganese, 0.01 weight percent of phosphorus, 0.04 weight percent of aluminum, 0.005 weight percent of niobium, 0.0015 to 0.009 weight percent in total of carbon, sulfur and nitrogen, and 0.005 to 0.04 weight percent of titanium at a temperature T (K) satisfying T (K)×(carbon weight percent+sulfur weight percent) ≦about 4.0 within a temperature range from about 900° to 1,300° C., hot rolling, and then coiling at a temperature of 550° C. for one hour. After pickling and cold rolling at a rolling reduction rate of 85 percent, the sheet was subject to continuous, annealing at a temperature of 880° C. for 20 seconds.

Synergistic effects of carbon, sulfur and nitrogen on deep drawability were then investigated.

Figure 1:
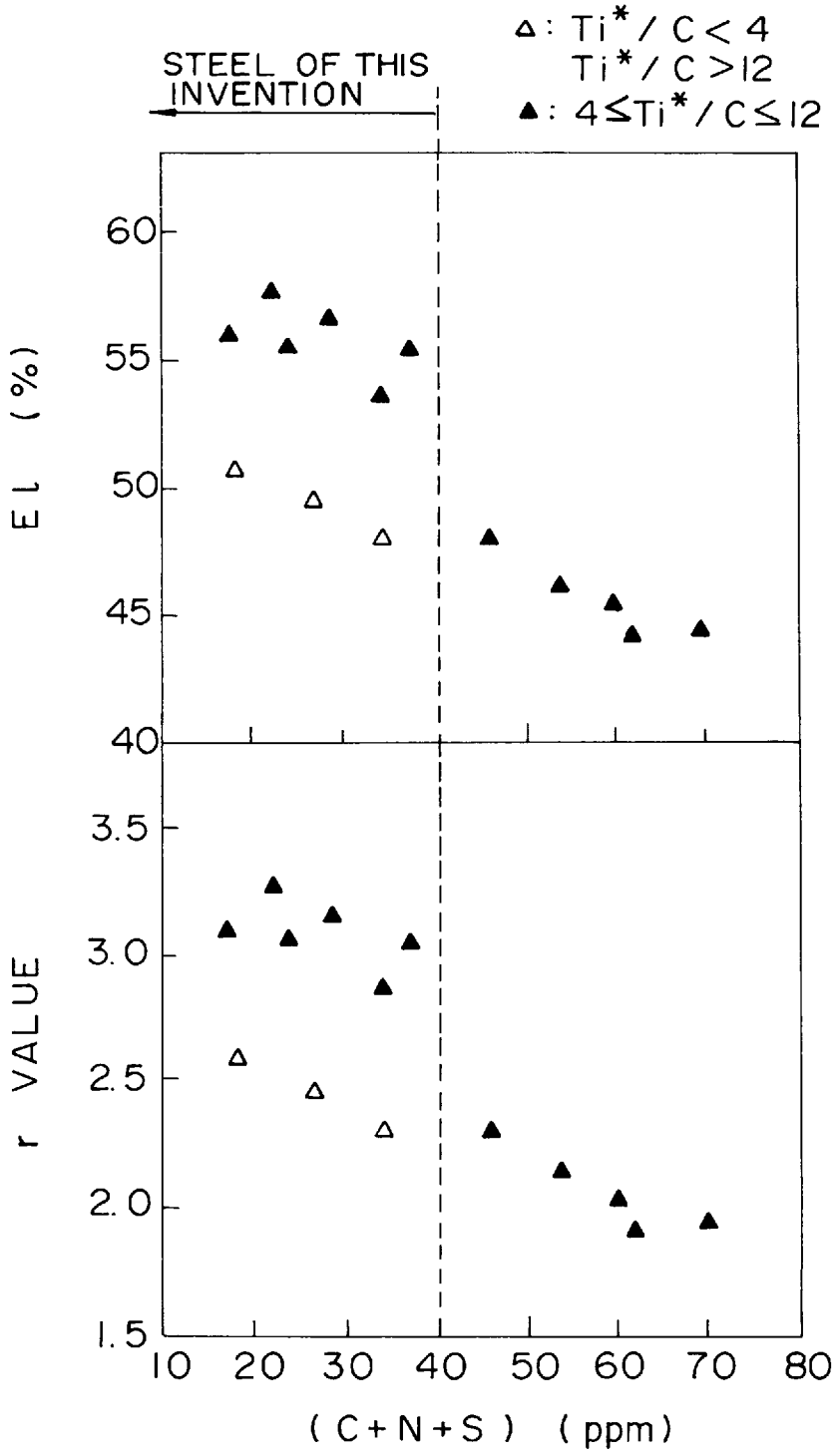
FIG. 1 is a graph showing the effects of (carbon weight percent+nitrogen weight percent+sulfur weight percent) and Ti*/C on the r-value and elongation (El)

FIG. 1 shows the discovered correlation between the total weight percent of carbon, sulfur and nitrogen, and the r-value or El-value (elongation), where the r-value is determined by the average of three values at 15% strain, i.e., the average of the L-direction value (rolling direction, $r_L$), the D-direction value (45° to the rolling direction, $r_D$), and the C-direction value (90° to the rolling direction, $r_C$). The r-value was measured using a JIS No. 5 test piece for tensile strength.

FIG. 1 reveals that the r-value and elongation greatly depend on the total weight percent of carbon, sulfur and nitrogen, and when the total weight of carbon, sulfur and nitrogen is about 0.004 weight percent or less, the r-value and elongation are significantly improved. In addition, when about 4≦Ti*/C≦about 12, r-value and elongation are both further increased. It is thought that the precipitation distribution changes in the hot-rolled steel sheet due to the decreased carbon, sulfur and nitrogen contents alters the recrystallized texture in a manner which improves r-value and elongation, although the precise mechanism has not been clarified.

We have investigated the correlation between deep drawability and the titanium, carbon, sulfur and nitrogen contents of the steel. In the investigation, steel sheets were produced by uniformly heating steel slabs containing 0.01 weight percent of silicon, 0.1 weight percent of manganese, 0.01 weight percent of phosphorus, 0.04 weight percent of aluminum, 0.005 weight percent of niobium, 0.0003 weight percent of boron, 0.005 to 0.04 weight percent of titanium, and a total of 0.004 weight percent of carbon, sulfur and nitrogen, at a temperature ranging from about 900° to 1,300° C., hot rolling, and then coiling at a temperature of 550° C. for one hour. After pickling and cold rolling at a rolling reduction rate of 85 percent, the sheet was subject to continuous, annealing at a temperature of 880° C. for 20 seconds.

Figure 2:
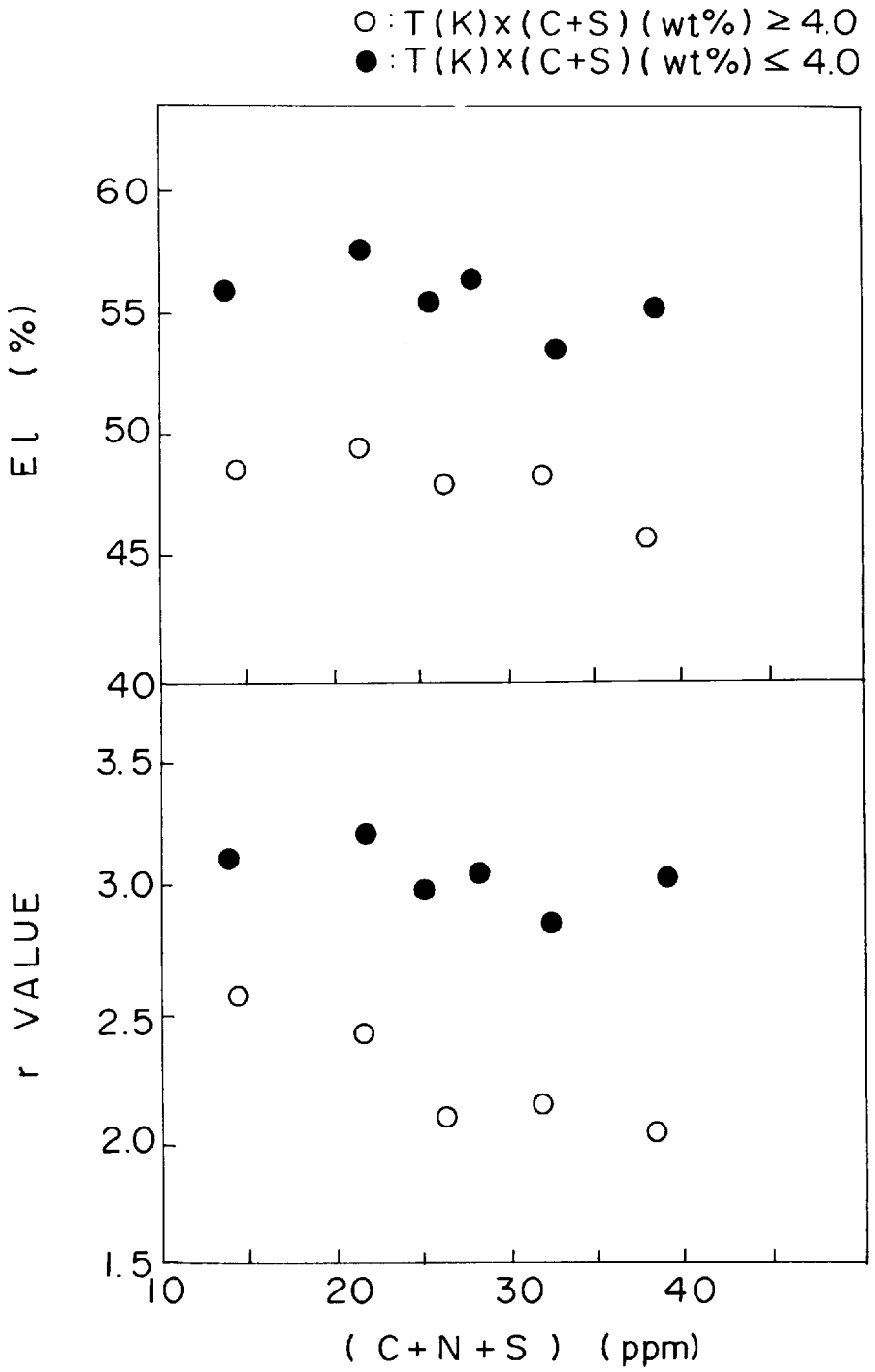
FIG. 2 is a graph showing the effect of T (K)×(carbon weight percent+sulfur weight percent) on the r-value and elongation (El).

FIG. 2 shows a correlation between T (K)×(C+S+N) (weight percent) and both the r-value and elongation. FIG. 2 demonstrates that the r-value and elongation greatly depend from T (K)×(C+S) (weight percent), and when T (K)×(C+S) (weight percent)≦about 4.0, the highest r-value and elongation are achieved.

Through further studies we have discovered an effective composition for the steel sheet of the invention. The ranges for the compositional elements of the steel sheet of the invention will now be explained.

Carbon: about 0.001 weight percent or less, sulfur: about 0.003 weight percent or less, and nitrogen: about 0.002 weight percent or less.

Since carbon, sulfur and nitrogen are important components which affect the precipitation behavior in the hot-rolled strip and, as a result, affect material properties such as elongation and r-value, their sum amount must be limited.

Regarding each component, the upper limit of the carbon content is about 0.002 weight percent to minimize losses in ductility, deep drawability, aging resistance, and recrystallization temperature; the upper limit of the sulfur content is about 0.003 weight percent to limit deterioration in deep drawability; and the upper limit of the nitrogen content is set at about 0.002 weight percent for similar reasons.

Further, the total amount of these elements is limited to about 0.004 weight percent or less in view of the workability measurements, e.g., r-value and elongation, as demonstrated above.

Silicon: about 0.1 weight percent or less.

Silicon is added to strengthen the steel. However, because a silicon content exceeding about 0.1 weight percent deteriorates workability, the upper limit of the silicon content is set at about 0.1 weight percent, and is preferably about 0.05 weight percent.

Manganese: about 0.3 weight percent or less.

Although manganese is required for deoxidation, excessive additions cause the formation of a brittle steel sheet having excessively high strength. Thus, the manganese content is set at about 0.3 weight percent or less.

Phosphorus: about 0.05 weight percent or less.

Since phosphorus effectively strengthens the steel, the content is adjusted according to the required strength level. However, because a content over about 0.05 weight percent decreases workability, phosphorus content is set at about 0.05 weight percent or less.

Aluminum: about 0.1 weight percent or less.

Aluminum is added to molten steel as a deoxidizer. Aluminum further improves the yield of elements forming carbides and nitrides, such as titanium and niobium. Since a content over about 0.1 weight percent provides no further improvement in the deoxidizing effect, the aluminum content is set at about 0.1 weight percent or less.

Titanium: about 0.005 to 0.02 weight percent.

Titanium is an important component for the precipitation of carbon, nitrogen, and sulfur as TiC, TiN, and TiS, respectively, in the present invention. To realize this precipitation, at least about 0.005 weight percent of titanium must be added to the steel. However, additions over about 0.02 weight percent cause poor workability. Thus, the titanium content must be controlled to about 0.02 weight percent or less in view of workability.

Further, the titanium content must be added to the steel in an amount to satisfy (Ti* weight percent)/(carbon weight percent)=about 4 to 12, wherein (Ti* weight percent)=(titanium weight percent)−48/14(nitrogen weight percent)−48/32(sulfur weight percent).

When the ratio, Ti*/C, is about 4 or more, a high r-value can be achieved in the cold rolled steel sheet. On the other hand, a ratio over about 12 causes lowering of the r-value, deterioration of surface properties, and increased cost due to the high titanium content.

Accordingly, titanium content must be controlled to satisfy the following equation:

about 4×(carbon weight percent)≦(titanium weight percent)−48/14(nitrogen weight percent)−48/32(sulfur weight percent)≦about 12×(carbon weight percent)

Niobium: about 0.001 to 0.01 weight percent.

Niobium effectively improves the workability of the steel in conjunction with titanium. Such improvement can be achieved by the adding at least about 0.001 weight percent. However, excessive additions of niobium cause workability deterioration in the steel sheet. Thus, the niobium content is limited to the range from about 0.001 to 0.01 weight percent.

Boron: about 0.0001 to 0.0010 weight percent.

Boron is added to improve the secondary working embrittlement and the planar anisotropy. Such improvement can not be achieved at a content of less than about 0.0001 weight percent, whereas an addition exceeding about 0.0010 weight percent causes poor workability. Thus, the boron content is limited to the range from about 0.001 to 0.0010 weight percent.

A process in accordance with the present invention will now be explained.

A steel slab having a composition in accordance with the present invention as set forth above is subject to hot rolling. During the hot rolling, the slab heating temperature ranges from about 900° to 1,300° C., and the workability is significantly improved when the heating temperature T satisfies the following equation, as evidenced by the above-mentioned experimental results:

T (K)×(carbon weight percent+sulfur weight percent) ≦about 4.0

Then, the slab is hot rolled at temperature over the $A_{C3}$ transformation temperature. The finishing temperature in the hot-rolling step is desirably set at a temperature over the $A_{r3}$ transformation temperature to improve workability.

Hot coiling after hot rolling is desirably carried out at a temperature of about 650° C. or less, and preferably at a temperature of about 500° to 600° C. in order to improve workability by promoting precipitation and coarsening the precipitates.

The resulting hot-rolled strip is then subject to cold rolling. We discovered that a higher rolling reduction rate causes a higher r-value in the steel sheet in accordance with the present invention. In particular, we found that excellent properties can be achieved by cold rolling at a rolling reduction rate of about 65 percent or more. However, a reduction rate over about 90 percent causes poor workability. Thus, the preferable rolling reduction rate ranges from about 70 to 85 percent.

The cold-rolled sheet is then subject to recrystallization annealing. The annealing temperature for recrystallization may range from about 700° to 950° C., and preferably from about 800° C. to 950° C. Either continuous annealing or box annealing may be used.

A continuous annealing line or continuous hot galvanizing line may be used in the present invention. Desirable hot galvanizing processes may include monolayer and two-layer plating processes based on an alloyed hot galvanizing process and a non-alloyed hot galvanizing process.

The invention will now be described through illustrative examples. The Examples are not intended to limit the scope of the invention defined in the appended claims.

EXAMPLE 1

Steel slabs, each having a composition as shown in Table 1, were uniformly heated, subjected to rough hot rolling, and then were subject to finishing hot rolling. After the resulting hot-rolled strip was coiled and pickled, it was subject to cold rolling at a rolling reduction rate of 80 percent to form a cold-rolled steel sheet having a thickness of 0.8 mm. The cold-rolled sheet was then subjected to continuous annealing. Properties of the cold rolled steel sheet thusly obtained are shown in Table 2, along with the hot-rolling and annealing conditions.

The r-value was determined by the average of three values at 15% strain, i.e., the L-direction value (rolling direction, $r_L$), the D-direction value (45° to the rolling direction, $r_D$), and the C-direction value (90 ° to the rolling direction, $r_C$). The r-value was measured using a JIS No. 5 test piece for tensile strength.

Table 2 shows that each cold rolled steel sheet having a composition in accordance with the present invention and produced by the method in accordance with the present invention possesses a high elongation, a high r-value and exhibits excellent workability. In contrast, the comparative examples exhibit poor workability.

Table 3 shows the properties of galvanized cold rolled steel sheets produced by a continuous hot galvanizing line or an electrogalvanizing line from the cold-rolled sheets obtained under the conditions shown in Table 3. Table 3 reveals that galvanized cold rolled steel sheets produced in accordance with the present invention have excellent workability.

As described above, a cold rolled steel sheet in accordance with the present invention has excellent workability as compared with conventional cold rolled steel sheets, and can be readily produced.

Although this invention has been described with reference to specific elements and method steps, equivalent elements or method steps may be used, the sequence of steps may be varied, and certain steps may be used independently of others. Further, various other elements or control steps may be included, all without departing from the spirit and the scope of the invention defined in the appended claims.

TABLE 1

| Steel | C | Si | Mn | P | S | Al | N | Ti | Nb | B | Remarks |
|---|---|---|---|---|---|---|---|---|---|---|---|
| 1 | 0.0008 | 0.010 | 0.05 | 0.015 | 0.0010 | 0.025 | 0.0011 | 0.0090 | 0.005 | 0 | Ex. of the Invention |
| 2 | 0.0005 | 0.005 | 0.10 | 0.042 | 0.0018 | 0.040 | 0.0017 | 0.0108 | 0.009 | 0.0006 | Ex. of the Invention |
| 3 | 0.0006 | 0.020 | 0.03 | 0.0087 | 0.0020 | 0.032 | 0.0013 | 0.0140 | 0.008 | 0.0005 | Ex. of the Invention |
| 4 | 0.0009 | 0.015 | 0.03 | 0.020 | 0.0015 | 0.050 | 0.0010 | 0.0160 | 0.006 | 0.0004 | Ex. of the Invention |
| 5 | 0.0005 | 0.020 | 0.15 | 0.012 | 0.0025 | 0.060 | 0.0005 | 0.0110 | 0.008 | 0.0001 | Ex. of the Invention |
| 6 | 0.0007 | 0.013 | 0.07 | 0.100 | 0.0020 | 0.063 | 0.0030 | 0.0240 | 0.065 | 0.0007 | Comparative Ex. |
| 7 | 0.0008 | 0.040 | 0.15 | 0.022 | 0.0060 | 0.055 | 0.0005 | 0.0120 | 0.012 | 0.0001 | Comparative Ex. |
| 8 | 0.0015 | 0.028 | 0.52 | 0.074 | 0.0040 | 0.049 | 0.0015 | 0.0080 | 0.005 | 0.0004 | Comparative Ex. |

| Steel | C + N + S | (Ti − 48/14 × N − 48/32 × S)/C | Remarks |
|---|---|---|---|
| 1 | 0.0029 | 4.6607 | Ex. of the Invention |
| 2 | 0.0040 | 4.5429 | Ex. of the Invention |
| 3 | 0.0039 | 10.9048 | Ex. of the Invention |
| 4 | 0.0034 | 11.4683 | Ex. of the Invention |
| 5 | 0.0035 | 11.0714 | Ex. of the Invention |
| 6 | 0.0057 | 15.3061 | Comparative Example |
| 7 | 0.0073 | 1.6071 | Comparative Example |
| 8 | 0.0070 | −2.0952 | Comparative Example |

TABLE 2

| | Hot-rolling Conditions | | | | | | | | |
|---|---|---|---|---|---|---|---|---|---|
| | Slab Heating | | | | Annealing | Properties | | | |
| Steel | Temp.* $T_1$ (°C.) | T(K.) × (C + S) | FDT (°C.) | CT (°C.) | Temp. (°C.) | TS (MPa) | E1 (%) | R-Value | Remarks |
| 1 | 1200 (1473) | 2.6514 | 880 | 550 | 820 | 285 | 56 | 3.10 | Ex. of the Invention |
| 2 | 970 (1246) | 2.8589 | 880 | 600 | 860 | 274 | 57 | 2.85 | Ex. of the Invention |

TABLE 2-continued

| | Hot-rolling Conditions | | | | | | | | |
|---|---|---|---|---|---|---|---|---|---|
| | Slab Heating | | | | Annealing | Properties | | | |
| Steel | Temp.* $T_1$ (°C.) | T(K.) × (C + S) | FDT (°C.) | CT (°C.) | Temp. (°C.) | TS (MPa) | E1 (%) | R-Value | Remarks |
| 3 | 1000 (1273) | 3.3098 | 880 | 600 | 850 | 301 | 55 | 3.05 | Ex. of the Invention |
| 4 | 1050 (1323) | 3.1752 | 880 | 650 | 880 | 282 | 57 | 3.30 | Ex. of the Invention |
| 5 | 1050 (1323) | 3.969 | 880 | 640 | 850 | 305 | 55 | 3.25 | Ex. of the Invention |
| 6 | 1000 (1273) | 3.4371 | 880 | 540 | 830 | 320 | 48 | 2.40 | Comparative Ex. |
| 7 | 1250 (1473) | 10.3564 | 880 | 650 | 800 | 309 | 43 | 2.45 | Comparative Ex. |
| 8 | 900 (1173) | 6.4515 | 880 | 620 | 880 | 324 | 45 | 2.56 | Comparative Ex. |

*Figures in parentheses represent the slab heating temperature T(K.).

TABLE 3

| | Hot-Rolling Conditions | | | | | | | | |
|---|---|---|---|---|---|---|---|---|---|
| | Heating | | | | | Properties | | | |
| Steel | Temp.* $T_1$ (°C.) | T(K.) × (C + S) | FDT (°C.) | CT (°C.) | Kind of Plating | TS (MPa) | E1 (%) | r-Value | Remarks |
| 1 | 1200 (1473) | 2.6514 | 880 | 550 | Alloying hot galvanizing | 286 | 54 | 2.95 | Ex. of the Invention |
| 2 | 970 (1246) | 2.8589 | 880 | 600 | Alloying hot galvanizing | 280 | 55 | 2.76 | Ex. of the Invention |
| 3 | 1000 (1273) | 3.3098 | 880 | 650 | Electrogalvanizing (Zn) | 300 | 53 | 2.95 | Ex. of the Invention |
| 4 | 1050 (1323) | 3.1752 | 880 | 600 | Electrogalvanizing (Zn—Ni) | 280 | 54 | 3.15 | Ex. of the Invention |
| 5 | 1050 (1323) | 3.969 | 880 | 620 | Electrogalvanizing (Zn) | 295 | 55 | 3.16 | Ex. of the Invention |
| 6 | 1000 (1273) | 3.4371 | 880 | 680 | Electrogalvanizing (Zn—Fe) | 310 | 43 | 2.24 | Comparative Ex. |
| 7 | 1250 (1473) | 10.3564 | 880 | 600 | Alloying hot galvanizing | 300 | 40 | 2.31 | Comparative Ex. |
| 8 | 900 (1173) | 6.4515 | 880 | 580 | Electrogalvanizing (Zn) | 315 | 42 | 2.42 | Comparative Ex. |

*Figures in parentheses represent the slab heating temperature T(K.).

What is claimed is:

1. A cold rolled steel sheet having excellent press workability comprising:

about 0.001 weight percent or less of carbon (C), about 0.1 weight percent or less of silicon (Si), about 0.3 weight percent or less of manganese (Mn), about 0.05 weight percent or less of phosphorus (P), about 0.003 weight percent or less of sulfur (S), about 0.1 weight percent or less of aluminum (Al), about 0.002 weight percent or less of nitrogen (N), about 0.005 to 0.02 weight percent of titanium (Ti), about 0.001 to 0.01 weight percent of niobium (Nb), and the balance iron and incidental impurities;

wherein the sum weight percentage of carbon, sulfur, and nitrogen in said cold rolled steel sheet is about 0.004 weight percent or less, and the contents of titanium, carbon, sulfur, and nitrogen in said cold rolled steel sheet satisfy the equation:

about 4×(carbon weight percent)≦(titanium weight percent)−48/14(nitrogen weight percent)−48/32(sulfur weight percent)≦about 12×(carbon weight percent).

2. The cold rolled steel sheet according to claim 1, wherein said cold rolled steel sheet further comprises about 0.0001 to 0.0010 weight percent of boron as an alloy element.

3. A method for making a cold rolled steel sheet exhibiting excellent press workability, comprising:

preparing a steel slab having a composition as described in claim 1, said steel slab having an $A_{C3}$ transformation temperature;

heating said steel slab uniformly at a temperature T(K) satisfying the following equation:

T(K)×(carbon weight percent+sulfur weight percent) ≦about 4.0, and within a temperature range from about 900° to 1,300° C.;

hot rolling said steel slab at a finishing temperature of higher than said $A_{C3}$ transformation temperature to form a hot-rolled strip;

coiling said hot-rolled strip at a temperature of about 650° C. or less to form a coil;

pickling said coil;

cold rolling said coil after said pickling at a rolling reduction rate of about 65 to 90 percent to form a cold-rolled sheet; and recrystallization-annealing said cold-rolled sheet at a temperature ranging from about 800° to 950° C.

4. A method for making a cold rolled steel sheet exhibiting excellent press workability, comprising:

preparing a steel slab having a composition as described in claim 2, said steel slab having an $A_{C3}$ transformation temperature;

heating said steel slab uniformly at a temperature T(K) satisfying the following equation:

T(K)×(carbon weight percent+sulfur weight percent) ≦about 4.0, and within a temperature range from about 900° to 1,300° C.;

hot rolling said steel slab at a finishing temperature of higher than said $A_{C3}$ transformation temperature to form a hot-rolled strip;

coiling said hot-rolled strip at a temperature of about 650° C. or less to form a coil;

pickling said coil;

cold rolling said coil after said pickling at a rolling reduction rate of about 65 to 90 percent to form a cold-rolled sheet; and recrystallization-annealing said cold-rolled sheet at a temperature ranging from about 800° to 950° C.

* * * * *